US005557949A

United States Patent [19]

Mori et al.

[11] Patent Number: 5,557,949

[45] Date of Patent: Sep. 24, 1996

[54] DUST COLLECTING AND REMOVING DEVICE IN A CIRCULAR KNITTING MACHINE AND A KNIT FABRIC MANUFACTURING APPARATUS

[75] Inventors: Masakazu Mori, Aichi-ken; Toyotoshi Yoshioka, Toyota, both of Japan

[73] Assignees: Luwa Japan Ltd., Yokkaichi; Kabushiki Kaisha Fukuharaseiki Seisakusho, Kobe, both of Japan

[21] Appl. No.: 334,530

[22] Filed: Nov. 4, 1994

[30] Foreign Application Priority Data

Nov. 9, 1993 [JP] Japan ..... 5-304632

[51] Int. Cl.[6] ..... D04B 35/32

[52] U.S. Cl. ..... 66/168; 15/301

[58] Field of Search ..... 66/168; 15/301

[56] References Cited

U.S. PATENT DOCUMENTS

| | | | |
|---|---|---|---|
| 5,323,509 | 6/1994 | Igarashi et al. | 66/168 X |
| 5,327,749 | 7/1994 | Junger | 66/168 X |
| 5,363,676 | 11/1994 | Tsuchiya | 66/168 |

FOREIGN PATENT DOCUMENTS

| | | | |
|---|---|---|---|
| 566113 | 4/1992 | European Pat. Off. | 66/168 |
| 3305795 | 8/1984 | Germany | 66/168 |
| 3407973 | 9/1985 | Germany | 66/168 |
| 1657553 | 6/1991 | U.S.S.R. | 66/168 |

*Primary Examiner*—John J. Calvert

*Attorney, Agent, or Firm*—Flynn, Thiel, Boutell & Tanis, P.C.

[57] ABSTRACT

Dust particles generated in a circular knitting machine and a knit fabric manufacturing apparatus, which comprises a circular knitting machine and creels, are collected, thereby preventing the breakage of yarns and maintaining the quality of a knit fabric. There is provided an outer casing which is provided at the upper portion of the circular knitting machine and is open at the lower surfaces thereof and a dust collecting body which is provided inside the outer casing and has a cylindrical filter on which suction operation acts. There is provided an adjusting plate having a cylindrical portion between a knitting portion of the circular knitting machine and the dust collecting body, thereby sucking air including dust from the knitting portion. There is fixed a ring plate to the upper outer portion of the cylindrical portion, thereby sucking air including the dust from the portion close to the yarn supply device other than the knitting portion and the sucked air is cleaned by the filter. There is also provided a blowing nozzle inside the filter and a collecting nozzle outside the filter, thereby recovering the adsorbing capacity of the filter by collecting the dust stuck to the filter. There is provided a dust collector in a housing capable of collecting the dust. Detachable surfaces of the yarn packages of the yarn supply portion are covered by flexible curtains, thereby facilitating the replacing of the yarn packages.

10 Claims, 9 Drawing Sheets

DUST COLLECTING AND REMOVING DEVICE IN A CIRCULAR KNITTING MACHINE AND A KNIT FABRIC MANUFACTURING APPARATUS

BACKGROUND OF THE INVENTION

1. Field of the Invention

The present invention relates to a dust collecting and removing device in a circular knitting machine and a knit fabric manufacturing apparatus comprising a knitting portion such as a yarn carrier portion, a sinker portion, a sinker cap portion and a yarn needle portion in the circular knitting machine, a yarn feeding device provided over the knitting portion, a yarn guide portion and a yarn breakage accident detecting device. The yarn manufacturing device is integrated with the circular knitting machine in a room where the knitting machine room is installed (hereinafter referred to as a knitting room) for removing airborne dust as flocks which are generated, floated and collected in a creel for the circular knitting machine which detachably holds a plurality of yarn packages for feeding yarns to the circular knitting machine.

2. Prior Art

In case of knitting by a conventional circular knitting machine, several tens to one hundred plus yarn packages have been needed at a time. Particularly, in case of knitting by a cotton yarn, dust particles are generated in a yarn feeding device, and a yarn guiding device which are connected to the yarn packages, and are floated in the air in a large amounts. The amount of dust is increased as the machine is speeded up.

Since once the dust particles are airborne, they attach again to the yarn feeding device, yarn guide device and knitting portion of the circular knitting machine, they are scattered to machines adjoining to the yarn feeding device, etc. installed in a knitting room so as to cause deterioration of the quality of a knitted product such as yarn breakage and knitting flaw. To solve this problem, as a removing device for removing dust particles which are generated in the circular knitting machine, there has been employed a dust removing machine such as a motor fan or an air blower provided over the circular knitting machine for blowing off the dust.

However, there has been such a drawback in a dust removing machine for blowing off the dust particles by the motor fan, etc. that the dust particles are impossible to be collected and they deteriorate working surroundings in the knitting room, and exert a bad influence upon other machines although they are effective in each of the circular knitting machine.

In the conventional circular knitting machine, a plurality of yarn packages are disposed concentrically over the table of the circular knitting machine and there is a tendency that the given numbers of yarn packages are increased for an advancement of a multiplicity of yarn feedings in the circular knitting machine for improving productivity. On the other hand, as the yarn package has been recently enlarged, it has been difficult to dispose a heavy yarn package on the table.

Accordingly, a creel like a creel for a warper in a weaving mill has been used as a yarn package feeding means of the circular knitting machine. Dust particles which are floated in the air in the creel on which a plurality of yarn packages are mounted are accumulated on the creel and the packages on the creel. If they are left as they are, there has been generated such a drawback that the dust particles are attached to a yarn which is unwound from the yarn package and travel toward the circular knitting machine so that it is knitted in a knitted work to thereby generate knitting flaws.

Accordingly, there has been employed various dust removing devices for the creel such as a fan, a motor fan disposed on a ceiling and a traveling fan. However, such dust removing devices are insufficient for removing the dust particles in the creel and have such a drawback that the dust particles are scattered in the knitting room to thereby exert a bad influence on the circular knitting machine and swing the yarn which travels toward the circular knitting machine.

Whereupon, there has been proposed a method for removing dust particles by providing a housing which surrounds the periphery of the creel by a plate-shaped panel in which air is blown off from the upper portion thereof toward the creel and the yarn package and the blown-off dust particles are collected and removed by a dust collector disposed under the housing. In such a method, since the housing is formed of the plate-shaped panel, a panel in front of the yarn package is needed to be removed during replacement of a yarn package full of the yarn, which is performed when a bobbin is empty upon consumption of the yarn package on the creel. Accordingly, there has been such a drawback that additional labor has been needed during the replacement of the yarn package on the creel during the knitting operation of the circular knitting machine.

SUMMARY OF THE INVENTION

The present invention is to provide a dust collecting and removing device in a circular knitting machine and a knit fabric manufacturing apparatus capable of preventing yarns from being broken by collecting dust particles which are generated in a circular knitting machine and a knit fabric manufacturing apparatus composed of the circular knitting machine and creels. The knit fabric manufacturing apparatus also is capable of keeping the quality of the knit fabric, capable of improving a working environment, and capable of performing a replacement of yarn packages mounted on the creels in a yarn supply portion where dust particles can be collected.

In view of such aforementioned problems of the prior art that the quality of the knit fabric is deteriorated by the dust particles which are generated in the knit fabric manufacturing apparatus, and the collection of the dust particles in the creels is incompatible with the replacement of the yarn package with ease, the circular knitting machine includes an outer casing which is provided at the upper portion of the circular knitting machine and is opened at the lower surfaces thereof, a dust collecting body which is provided inside the outer casing and has a bottom plate and a rotatable cylindrical filter, a suction device provided in the outer casing and an adjusting plate which is provided between a knitting portion of the circular knitting machine and the dust collecting body and has a cylindrical portion at the lower portion thereof, thereby sucking the air including the dust from the knitting portion and cleaning the air by a filter of the dust collecting body.

Further, a ring plate is fixed to the upper outer portion of the cylindrical portion of the adjusting plate, thereby sucking air including dust particles from the portion adjacent to the yarn supply device other than the knitting portion and cleaning the air while a blowing nozzle is provided at the inner surface side of a rotatable filter and a collecting nozzle is provided at the outer surface side for performing the suction operation respectively, thereby recovering the suction capacity of the filter by collecting the dust stuck to the filter.

In the creels as the yarn supply portion, detachable portions of the yarn packages in a housing in which creels are disposed are covered with flexible curtains, thereby facilitating replacement of the yarn packages. Further, an air blower is disposed at the upper portion of the housing and a dust collector is provided at the lower portion of the housing, thereby collecting the dust particles which are generated in the creels. Still furthermore, since a filter cleaning device for filtering the dust collector is provided and the filter cleaning device is connected to the dust collecting box, thereby recovering the suction capacity of the filter.

PREFERRED EMBODIMENT OF THE INVENTION

Figure 1:
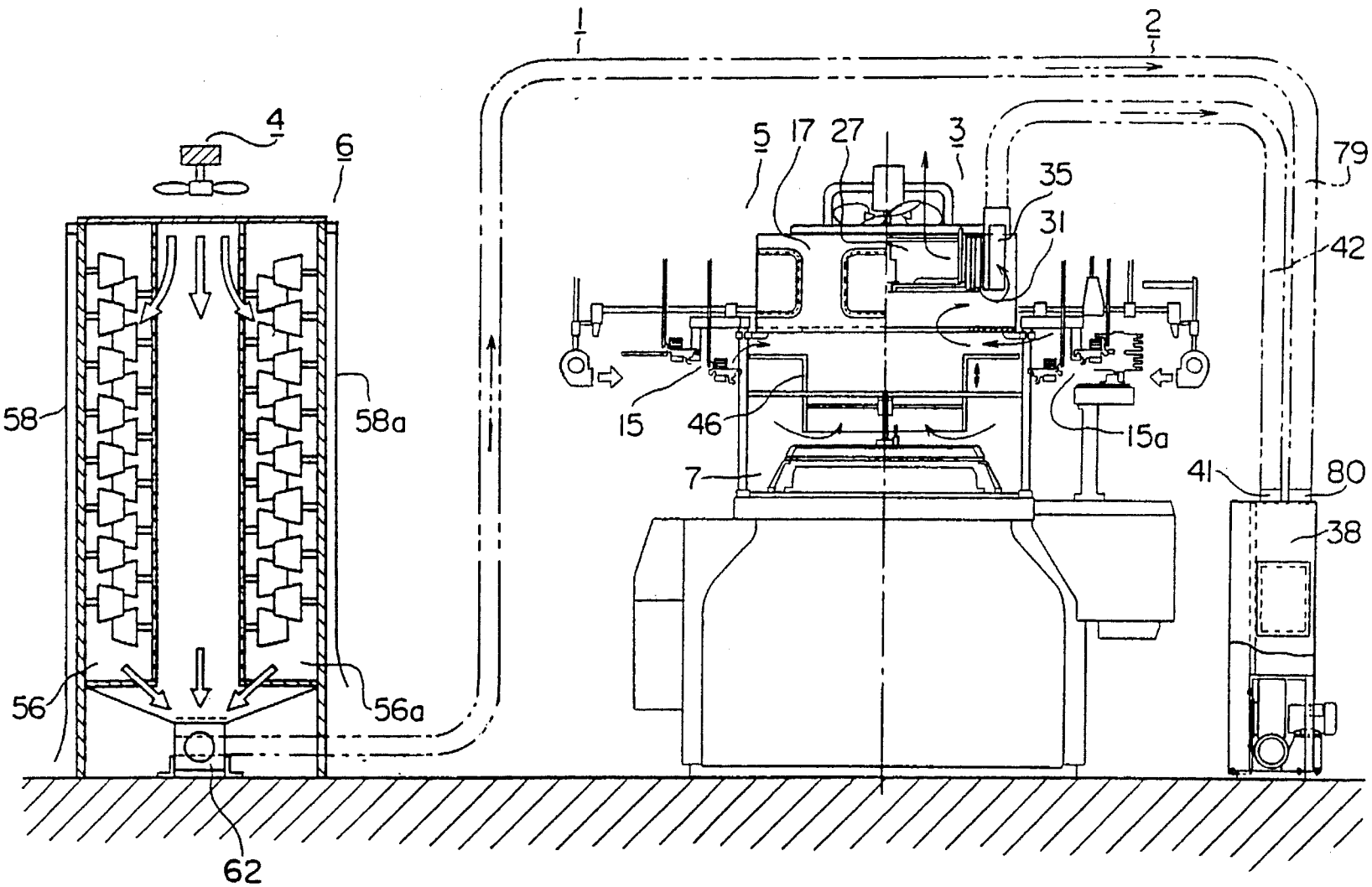
FIG. 1 is a front view of a fabric knit apparatus according to the present invention.
Figure 2:
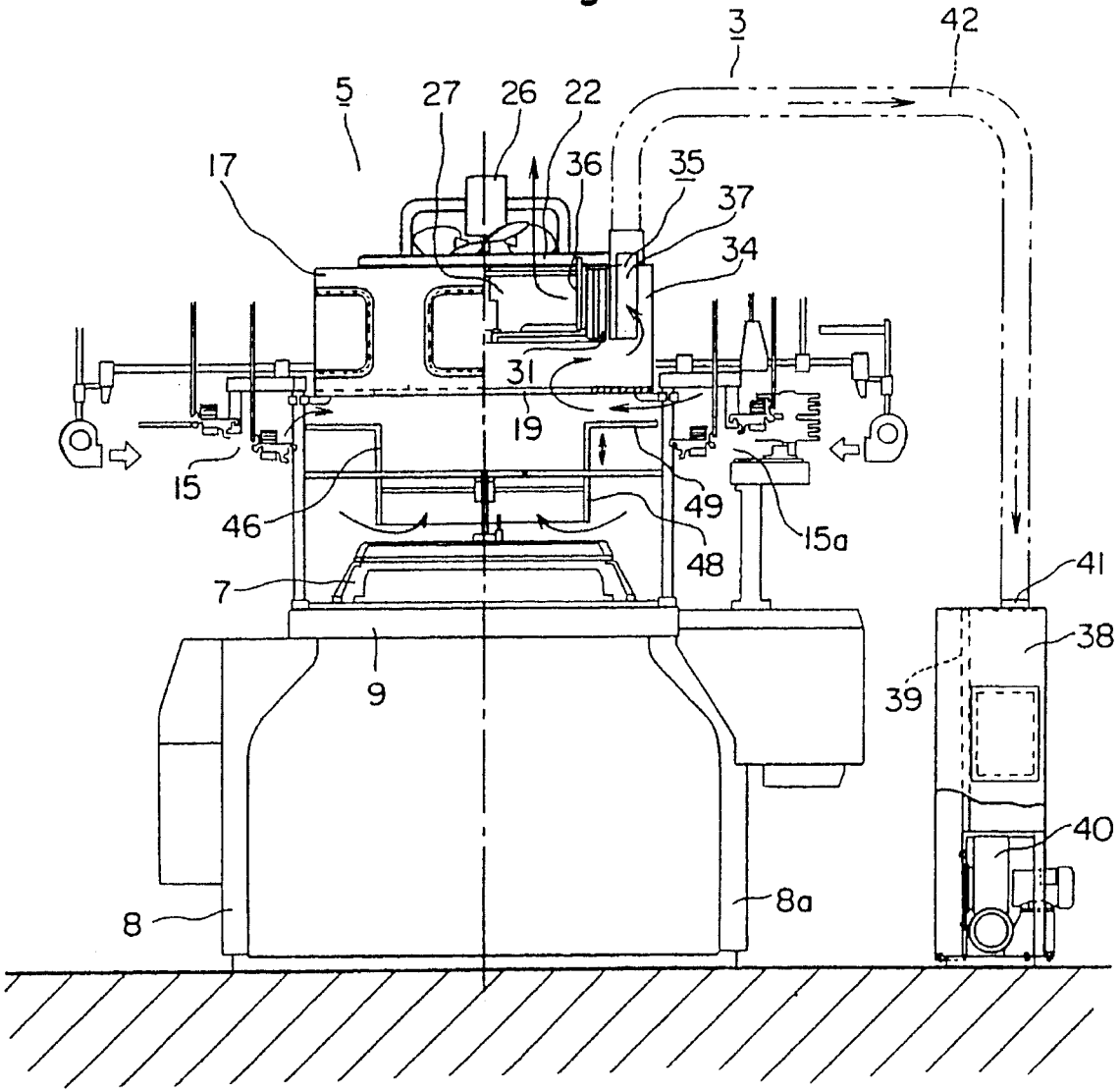
FIG. 2 is front view of a circular knitting machine.
Figure 3:
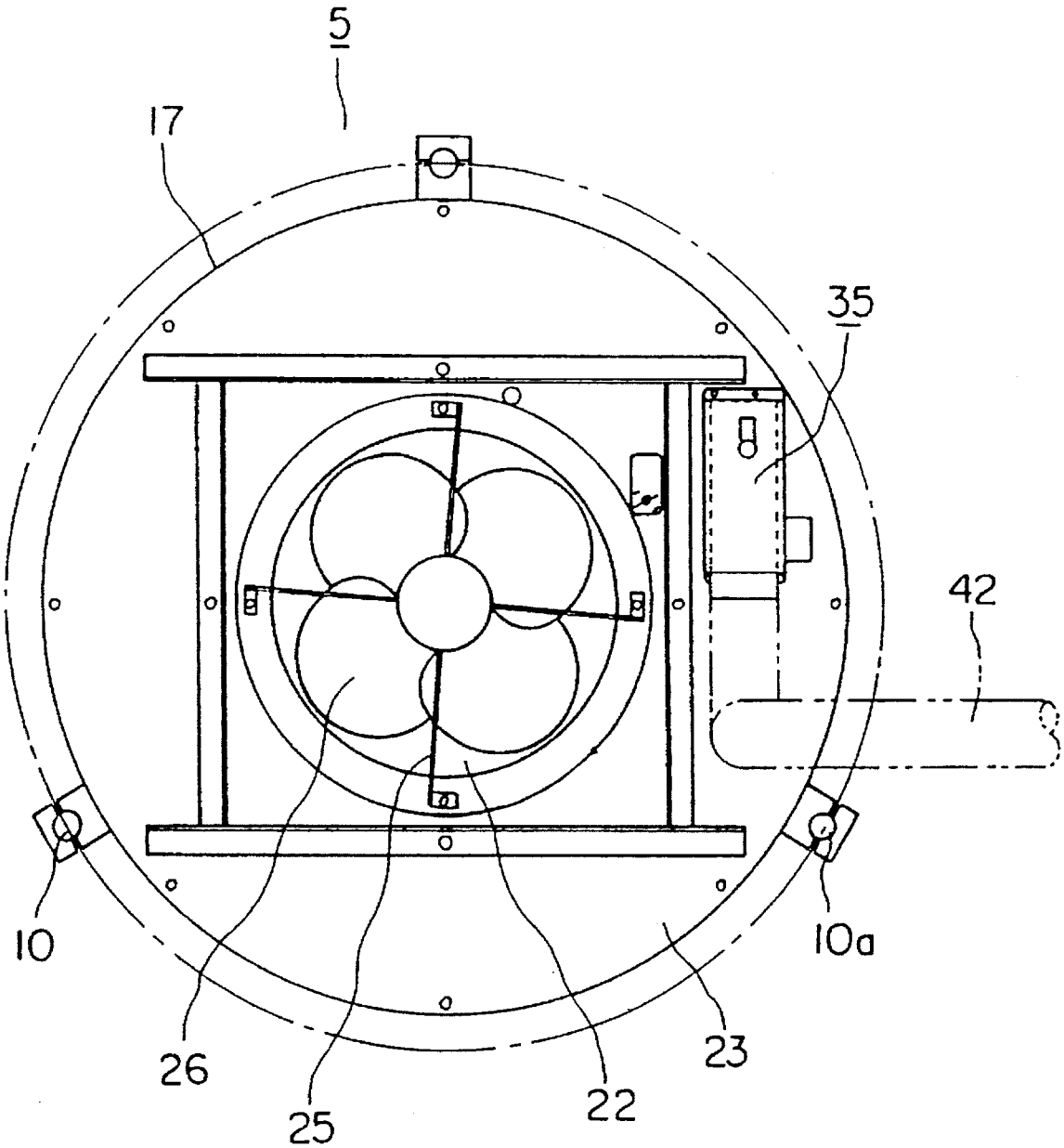
FIG. 3 is a plan view of a main portion of the circular knitting machine in FIG. 2.
Figure 4:
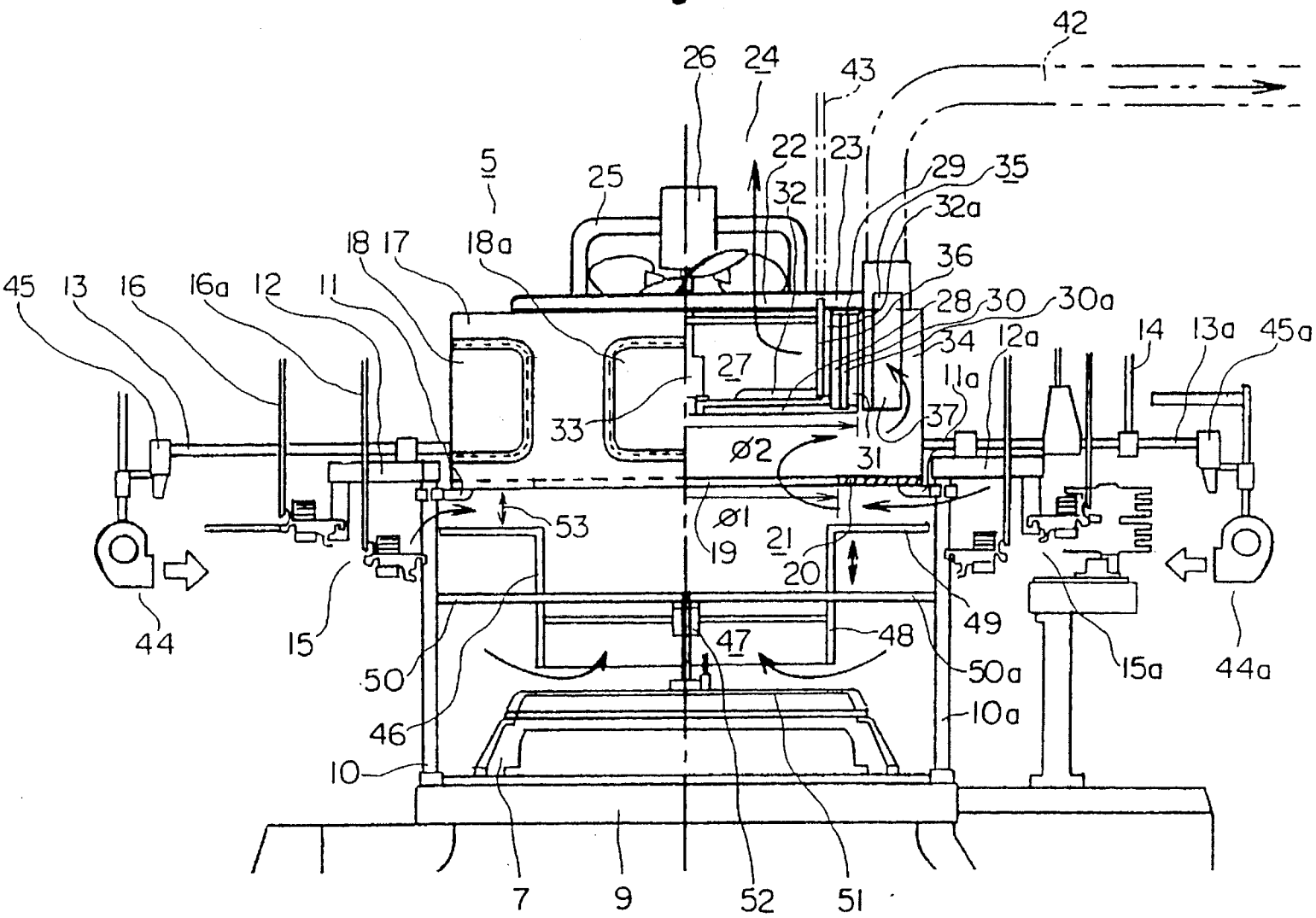
FIG. 4 is an enlarged view of a main portion of the circular knitting machine in FIG. 2.
Figure 5:
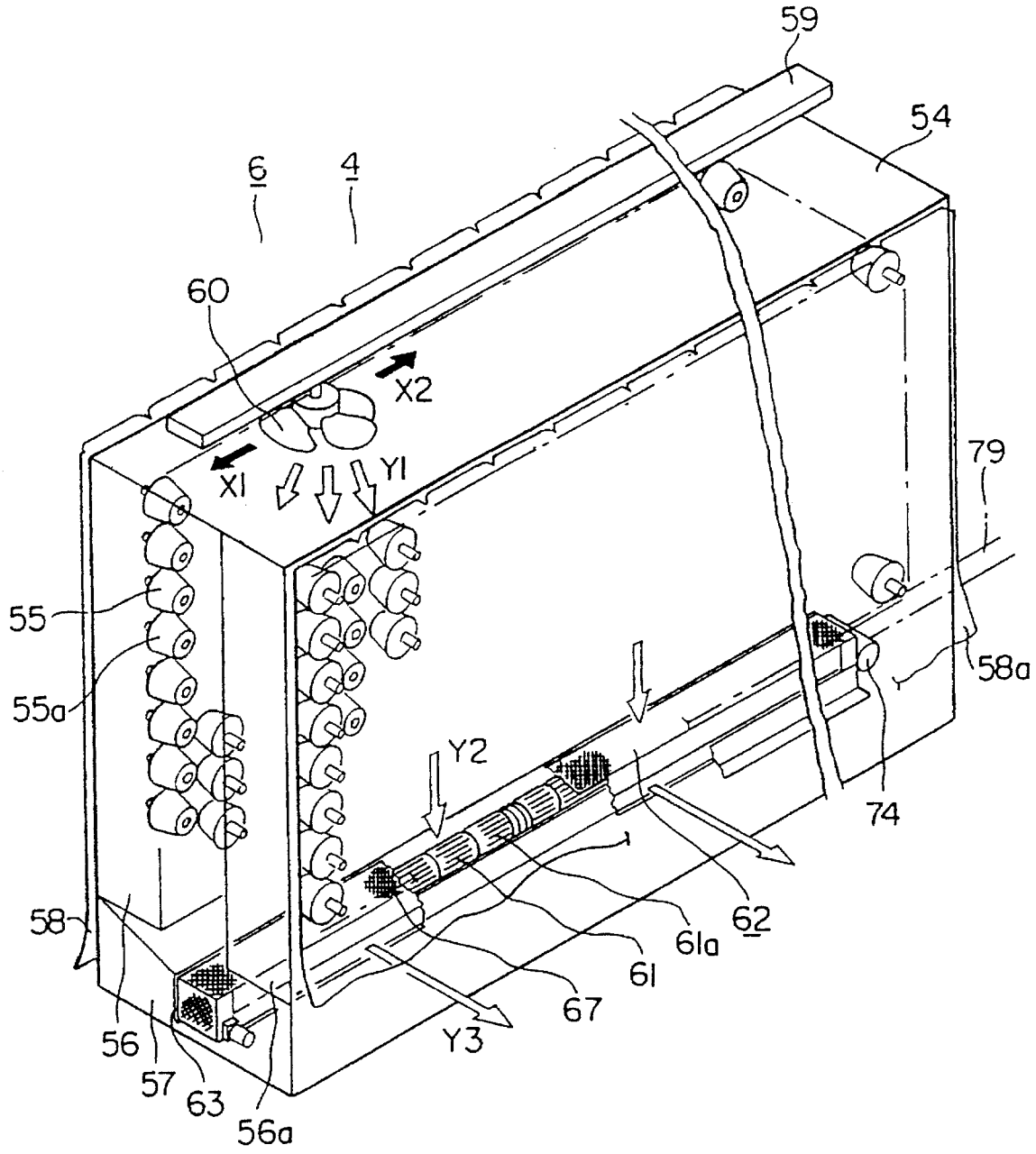
FIG. 5 is a schematic perspective view showing a yarn supply portion.
Figure 6:
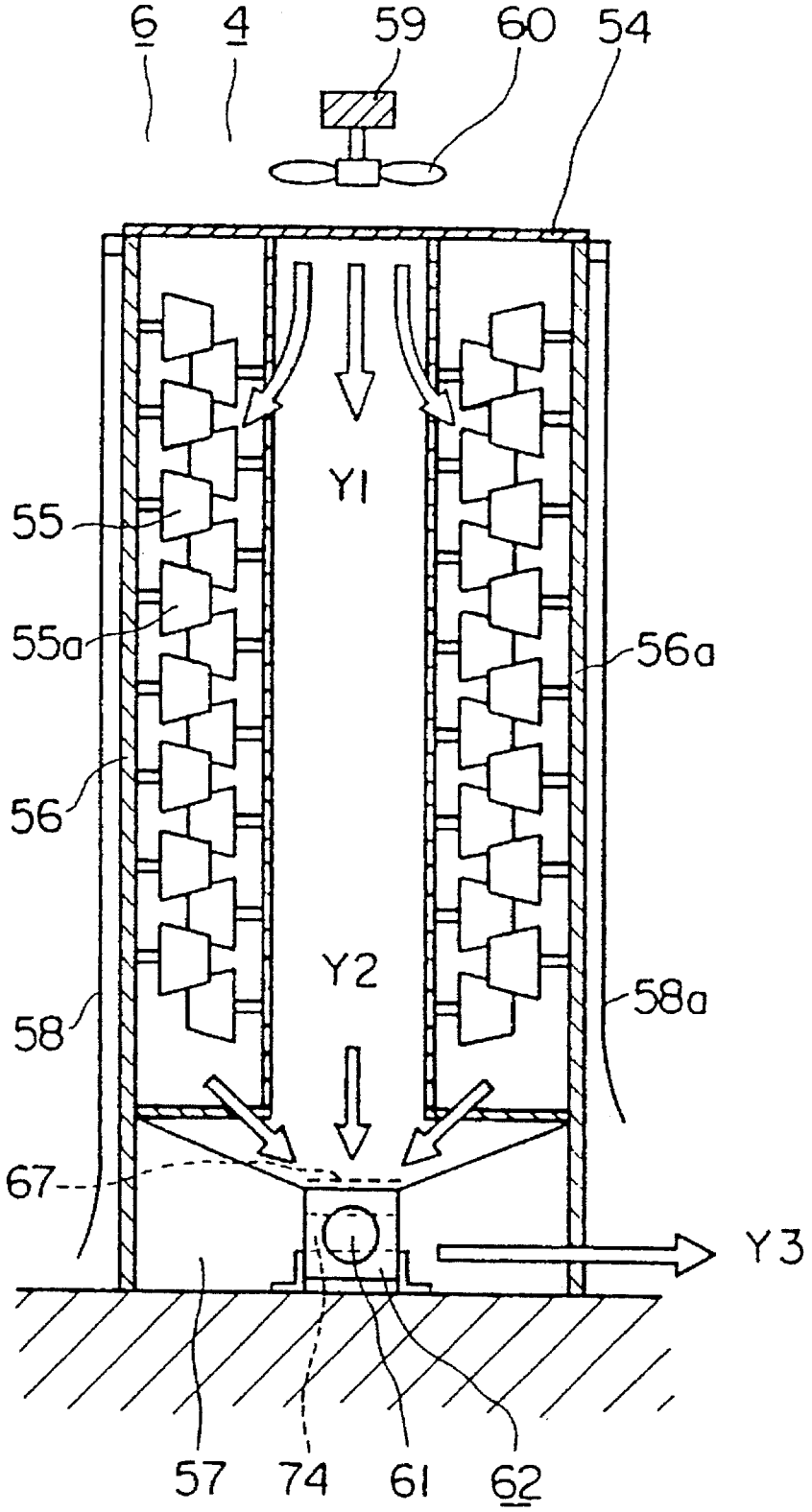
FIG. 6 is a side view of the yarn supply portion in FIG. 5.
Figure 7:
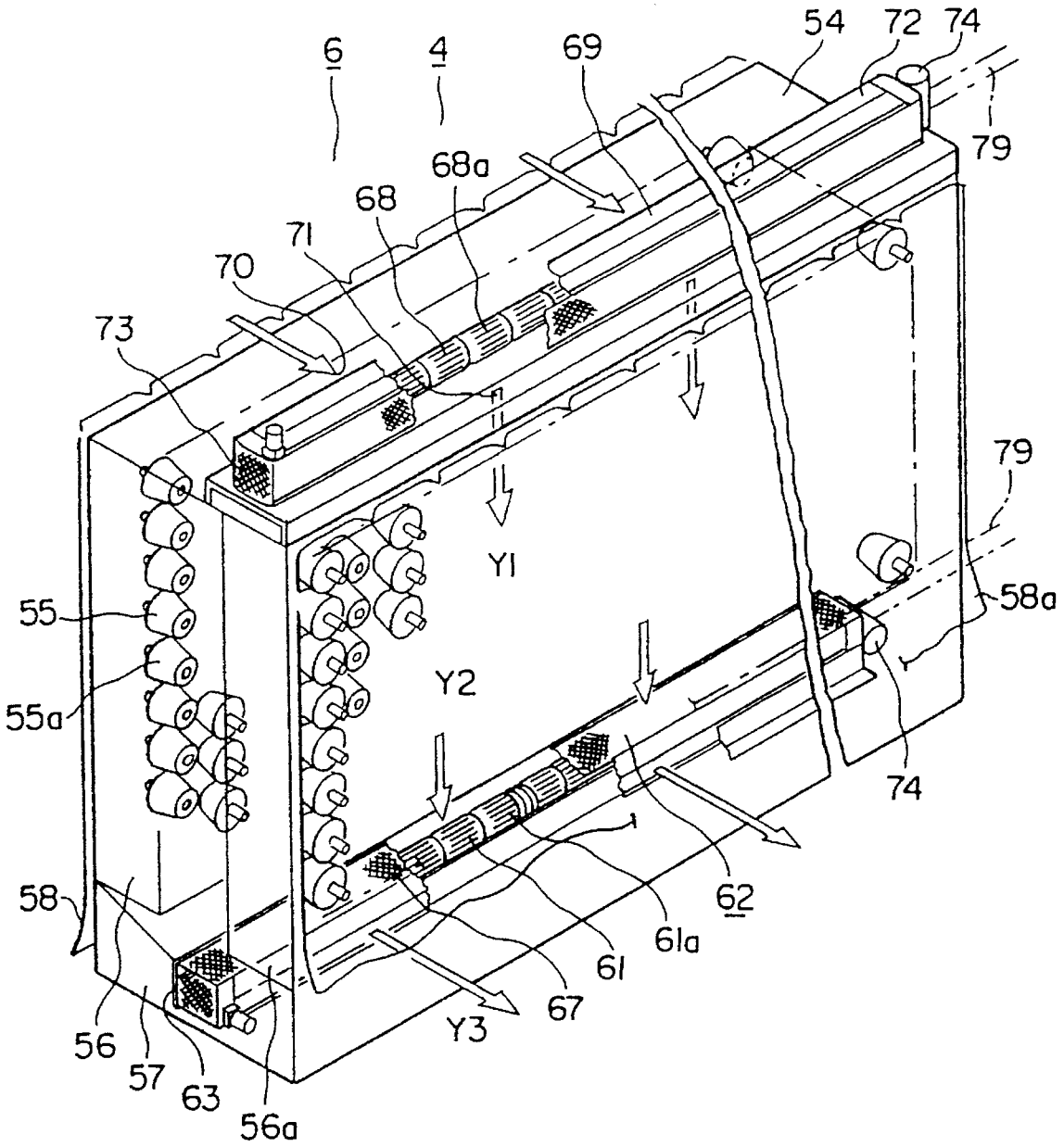
FIG. 7 is a schematic perspective view showing a yarn supply portion according to another embodiment of the invention.
Figure 8:
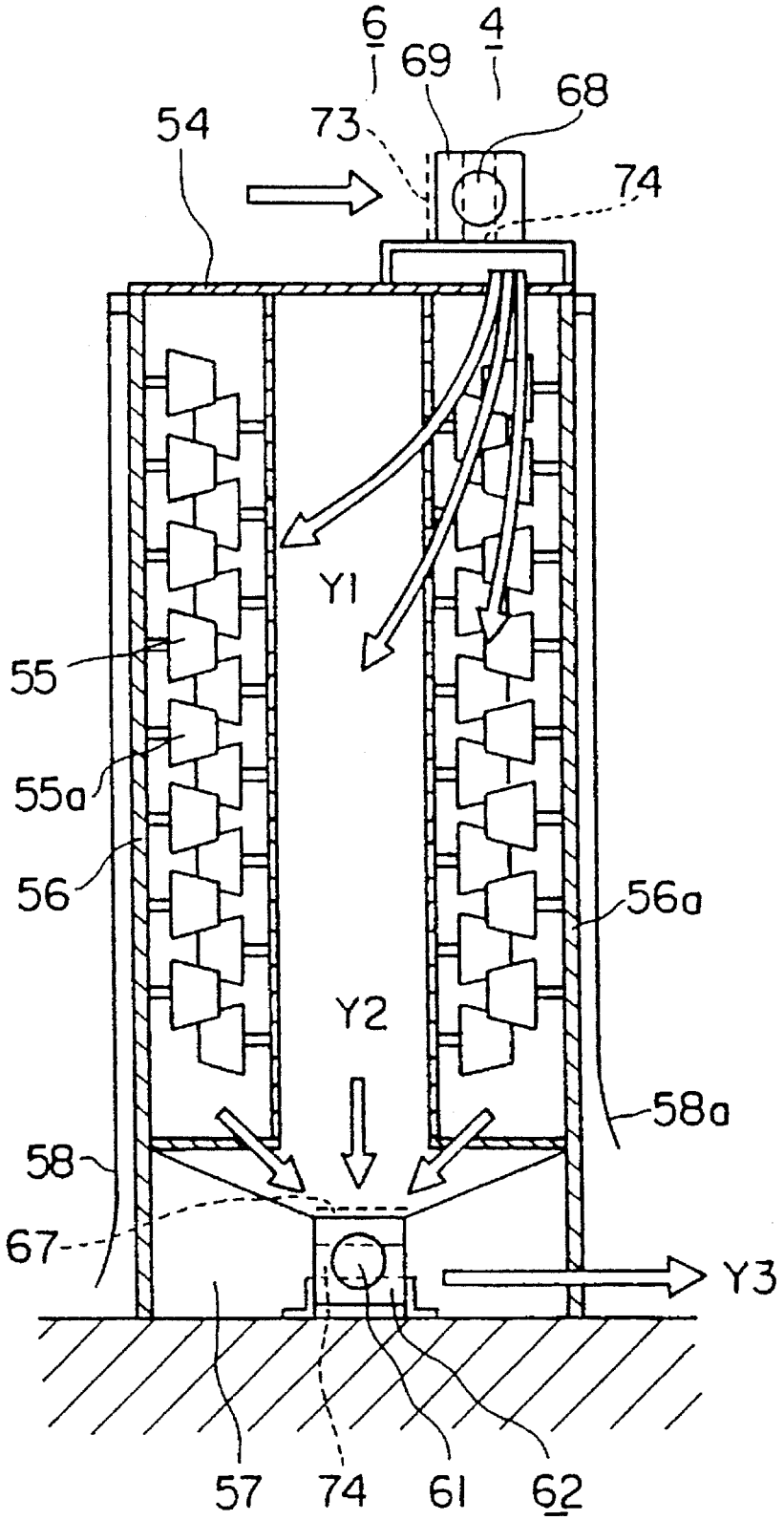
FIG. 8 is a side view of the yarn supply portion in FIG. 7.
Figure 9:
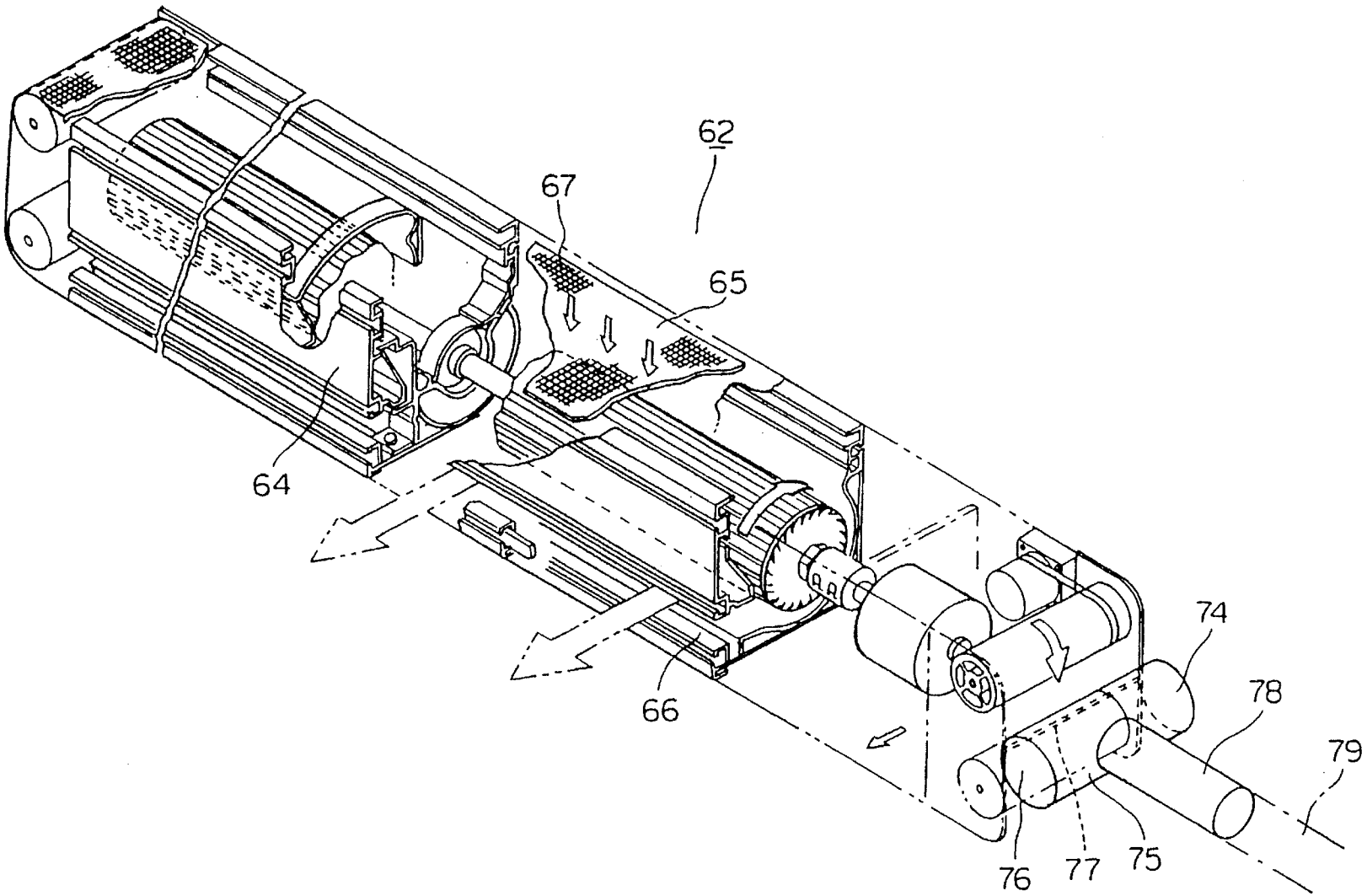
FIG. 9 is a perspective view showing an example of a dust collector.

A dust collecting and removing device in a circular knitting machine and a knit fabric manufacturing apparatus according to a preferred embodiment of the invention will be described with reference to FIGS. 1 to 9.

Denoted at I is an entire fabric knit apparatus provided with a dust collecting and removing device 2 wherein the fabric knit apparatus comprises a circular knitting machine 5 having dust collecting portions 3 and 4 and a yarn supply portion 6.

Denoted at 7 is a knitting portion of the circular knitting machine 5 and the knitting portion 7 is disposed over a bed 9 which is supported by a plurality of leg bodies 8, 8*a* provided on the surface of a floor. The knitting portion 7 includes a cylindrical yarn portion, a yarn carrier portion and a sinker portion, etc. which are not shown.

Denoted at 10, 10*a* are plurality of posts which stand on the bed 9. First supporting arms 11, 11*a* project laterally from the upper portion of the posts 10, 10*a* in the inward direction of the posts 10, 10*a* and second supporting arms 12, 12*a* project laterally from the posts 10, 10*a* above the supporting arms 11, 11*a* in the outward direction of the post 10, 10*a*.

Denoted at 13, 13*a* are horizontal members which are provided on the second supporting arms 12, 12*a*. The horizontal members 13, 13*a* are supported by a plurality of supporting members 14, 14*a* which are suspended from a ceiling. Yarn supply devices 15, 15*a* are disposed on the posts 10, 10*a* and the second supporting arms 12, 12*a* vertically relative to each yarn supply port of the knitting portion 7.

There are provided a plurality of yarn introduction pipes 16, 16*a* between the yarn supply devices 15, 15*a* of the circular knitting machine 5 and the yarn supply portion 6 so as to supply many yarns at the same time from the yarn supply portion 6.

Denoted at 17 is an outer casing of the dust collecting portion 3 which is provided over the knitting portion 7 of the circular knitting machine 5. The outer casing 17 is placed on the supporting arms 11, 11*a* of the posts 10, 10*a*. Window portions 18, 18*a* are provided on the outer peripheral surface of the cylindrical portion of the outer casing 17 and a ring-shaped closed frame body 20 having an opening 19 of an opening radius of $\phi 1$ is provided under the outer casing 17, thereby forming a suction side 21 of the dust collecting portion 3.

Denoted at 22 is an opening of a discharge side provided at a ceiling 23 of the outer casing 17. A suction device 26 composed of an axial flow fan is attached to a supporting frame 25 which is fixed to the ceiling 23 so as to face the opening 22.

Denoted at 27 is a dust collecting body which is rotatably disposed inside the outer casing 17. The dust collecting body 27 comprises a ring-shaped upper frame body 29 which is fixedly supported on a circular bottom plate 28 by rod-shaped supporting portions 30, 30*a* which are disposed at given intervals, and a cylindrical filter 31 which is fixed upright to the bottom plate 28 beside the upper frame body 29 at the peripheral portion of the bottom plate 28, wherein the dust collecting body 27 is held inside the outer casing 17 by way of attaching members 32, 32*a* so that the upper portion of the dust collecting body 27 contacts the lower surface of the ceiling 23 of the outer casing 17.

A radius of $\phi 2$ of the outer periphery of the filter 31 of the dust collecting body 27 is greater than an opening radius of $\phi 1$ of the opening 19 provided under the outer casing 17.

Denoted at 33 is a driving motor provided at the attaching shaft which hangs from and is fixed to the ceiling 23 of the outer casing 17 at the central portion of the dust collecting body 27. The dust collecting body 27 is rotatable by the driving motor 33. There is provided a suction flow passage 34 having a predetermined interval between the outer peripheral side wall of the outer casing 17 and the outer peripheral surface of the filter 31 of the dust collecting body 27.

The filter 31 in the dust collecting body 27 is formed so as to be rotatable while it is fixed to the bottom plate 28. However, the bottom plate 28 of the dust collecting body 27 is fixed relative to the outer casing 17 and the filter 31 is formed of an endless belt shape and supported by a guide roller, etc., so that it is may be rotatably moved relative to the bottom plate 28.

The filter 31 is not limited to the aforementioned one but may be formed of a body formed of two or more divided bodies which are connected to one another. The size of many ventilation holes, which is formed by perforating the filter 31, is preferably 20 to 40 meshes per inch and is most preferably 30 meshes. The filter 31 may be replaced with a wire net or a punched plate having meshes corresponding to those of the filter 31.

Denoted at 35 is a filter cleaning device which is provided at a given position inside the outer casing 17. The filter cleaning device 35 is disposed inside the filter 31 of the dust collecting body 27 that is provided inside the outer casing 17. The filter cleaning device 35 comprises a blowing nozzle 36 which generates air current for blowing off the dust particles accumulated on the outer surface of the filter 31 from the inside thereof and a collecting nozzle 37 which is disposed outside the filter 31 but inside a suction flow passage 34 of the outer casing 17 in a position confronting the blowing nozzle 36 for collecting the dust particles which are blown off by the blowing nozzle 36 and discharging such dust to the outside.

Denoted at 38 is a collecting box of the dust collecting and removing device 2 of the fabric knit apparatus 1. The collecting box 38 permits a suction operation to act on the dust collecting portion 3 of the circular knitting machine 5 and the dust collecting portion 4 of the yarn supply portion 6.

A filter 39 and a fan 40 are provided inside the collecting box 38. A suction port 41 of the collecting box 38 and the collecting nozzle 37 of the filter cleaning device 35 corresponding to the dust collecting body 27 disposed on the circular knitting machine 5 are connected by a suction pipe 42, thereby permitting the suction operation to act on the collecting nozzle 37 such that compressed air is supplied to the blowing nozzle 36 confronting the collecting nozzle 37 by way of a pipe 43.

Denoted at 44, 44*a* are air blowers which are disposed at the tip ends of the horizontal members 13, 13*a* provided at the upper portion of the circular knitting machine 5 and outside the yarn supply devices 15, 15*a*. The air blowers 44, 44*a* are vertically adjustable in an angular interval by way of connecting members 45, 45*a* provided at the tip ends of the horizontal members 13, 13*a* and they are attached to the horizontal members 13, 13*a* so as to blow the air toward the upper central portion of the circular knitting machine 5. The air blowers 44, 44*a* can be rotated at the outer peripheral side of the yarn supply devices 15, 15*a*, if need be.

Denoted at 46 is an adjustable plate provided between the upper portion of the knitting portion 7 and the dust collecting portion 3 of the circular knitting machine 5. The adjustable plate 46 is integrated with a collar-shaped ring plate 49 that projects outward from the upper end of a cylindrical portion 48 which has a suction portion 47 confronting the knitting portion 7 of the circular knitting machine 5. Tip ends of the supporting members 50, 50*a* which are fixed to the cylindrical portion 48 are vertically movably attached to the posts 10, 10*a* of the circular knitting machine 5.

A supporting base portion 51, which is provided at the upper portion of the knitting portion 7 of the circular knitting machine 5, and a driving portion 52, which is attached to the supporting base portion 51, are connected to the supporting members 50, 50*a* of the adjusting plate 46 so that the adjusting plate 46 is automatically vertically movable.

An amount of projection or a width of the ring plate 49 on the adjusting plate 46 and a height of a suction flow passage 53 which is formed between the frame body 20 of the outer casing 17 and the upper surface of the adjustable plate 46 are determined by the positions of the yarn supply devices 15, 15*a* and the air blowers 44, 44*a*. Further, the vertical movement of the adjustable plate 46 is not limited to the automatic one but may be a manual one.

Described hereinafter are the yarn supply portion 6 and the dust collecting portion 4 of the knit fabric manufacturing apparatus 1.

Denoted at 54 is a housing of the yarn supply portion 6 and two sets of creels 56, 56*a* on which a plurality of yarn packages 55, 55*a* are mounted in the housing 54 and are disposed on a base 57. Detachable surfaces of the yarn packages 55, 55*a* forming outer surfaces of the housing 54 are covered by flexible curtains 58, 58*a*.

Denoted at 59 is a rail disposed at the central upper portion of the housing 54. An air blower 60 composed of an air blower fan is movably attached to the rail 59 in the longitudinal direction of the housing 54, namely, in the direction of reference arrows X1 and X2. A dust collector 62 in which suction fans 61, 61*a*, each composed of a cross flow fan are incorporated is disposed on the base 57 at the central lower portion of the housing 54.

A casing 64 of the dust collector 62 is disposed inside an attaching recessed portion 63 provided at the central portion of the base 57. An upper surface 65 and a side surface 66 of the casing 64 are opened. A filter 67 covers the upper surface 65. By the operation of the suction fans 61, 61*a*, air is circulated and sucked from the upper surface 65 of the casing 64 and is cleaned by the filter 67 so that the cleaned air is discharged from the side surface 66 and the base 57.

As another embodiment of the dust collecting portion 4 of the yarn supply portion 6, it comprises a dust collector which is the same structure as the dust collector 62 disposed at the lower portion of the housing 54 and the air blower 60 provided at the upper portion composed of an air blower 69 in which cross flow fans 68, 68*a* are incorporated, wherein the dust collector which has the same structure as the dust collector 62, is laterally laid on the upper portion of the yarn supply portion 6.

That is, a plurality of cross flow fans 68, 68*a* are disposed inside a casing 72 having a side surface 70 and a lower surface 71 which are respectively opened. A filter 73 covers the side surface 70. Air is circulated through the filter 73 and the cleaned air is blown off from the lower surface 71 toward the creels 56, 56*a* inside the housing 54.

A filter cleaning device 74 for cleaning the filters 67 and 73 of the dust collector 62 and the air blower 69 are disposed at the lower and upper portion of the yarn supply portion 6. A collecting nozzle 75 having a cylindrical suction cylinder 76 is disposed so as to contact the filters 67 and 73 wherein a slit 77 open in the direction of the axial line of the outer periphery of the suction cylinder 76. A connecting portion 78 is provided at a given position of the suction cylinder 76 for performing a suction operation.

Denoted at 79 is a suction pipe for use in the dust collecting portion 4 of the yarn supply portion 6. One end of the suction pipe 79 is connected to a suction port 80 of the collecting box 38 and the other end of the suction pipe 79 is connected to the connecting portion 78 of the filter cleaning device 74 so that the suction operation acts on the collecting nozzle 75 of the filter cleaning device 74 relative to the filters 67 and 73.

An operation of the dust collecting and removing device in the circular knitting machine will be described hereinafter.

Flies are generated and accumulate at the portion close to the yarn supply devices 15, 15*a* that are provided for supplying yarns which yarns are supplied from the creels 56, 56*a* of the yarn supply portion 6 to the knitting portion 7 of the circular knitting machine 5 in a given tension. The flies are sucked in the suction flow passage 53 formed between the frame body 20 provided at the lower surface of the outer casing 17 and the ring plate 49 of the adjustable plate 46 as illustrated by the arrows in the figures due to the air blowing operation by the air blowers 44, 44*a* and the suction operation by the suction device 26 of the outer casing 17.

Successively, air passes in the peripheral direction in the outer casing 17 so as to perform a U-turn through the opening 19 of the frame body 20 and then passes inside the outer casing 17 through the suction flow passage 34 formed between the outer casing 17 and the dust collecting body 27. Then, the air including the is filtered by the filter 31 of the dust collecting body 27 when when passing through the filter 31 and the cleaned air is circulated in the knitting room by the suction device 26 from the opening 22 which is opened on the ceiling 23 of the outer casing 17.

The suction force of the suction device 26 is applied to the dust particles which are generated in the knitting portion 7 of the circular knitting machine 5 by way of the cylindrical portion 48 of the adjustable plate 46. The thus sucked dust particles merge into the air including the dust from the yarn supply devices 15, 15*a* at the opening 19 of the outer casing 17 and it is cleaned in the manner as set forth above.

The blowing nozzle 36 disposed inside the filter 31 blows compressed air toward dust stuck to the filter 31 for cleaning the air including dust particles so as to blow off the dust and the blown off dust particles are collected by the collecting nozzle 37 disposed at the position confronting the blowing nozzle 36, thereby recovering the adsorbing capacity.

An operation of the dust collecting and removing device of the yarn supply portion alone in the knit fabric manufacturing apparatus will be described hereinafter.

When the circular knitting machine 5 is operated, the air blower 60 and dust collector 62 of the dust collecting portion 4 in the yarn supply portion 6 are operated at the same time. An air flow Y1, which is supplied by the air blower 60, blows off the flies on the creels 56, 56*a* and flows downward in the direction of an arrow Y2 and reaches the dust collector 62 so that the filter 67 removes the dust from the air, thereby circulating the cleaned air alone into the knitting room in the direction of an arrow Y3. When the yarn packages 55, 55*a* mounted on the creels 56, 56*a* in the housing 54 are replaced, after the yarns are unwound from the yarn packages 55, 55*a* which requires, with new yarn packages around which yarns are wound full, the flexible curtains 58, 58*a* are rolled upward so that the detachable surfaces of the yarn packages 55, 55*a* are exposed.

When the air blower 69 is used instead of the air blower 60, the air currents for blowing off the dust in the longitudinal direction of the housing 54 are generated at the same time so that the dust particles are collected by the dust collector 62. When the dust particles are accumulated on the filters 67 and 73 in the dust collector 62 and air blower 69, the dust stuck to the filters 67 and 73 are collected due to the suction force of the collecting box 38 through the slit 77 of the collecting nozzle 75 thereby recovering the adsorbing capacity of the filters 67 and 73.

An operation of the dust collecting and removing device in the knit fabric manufacturing apparatus as a whole will be described hereinafter.

When the collecting box 38 in the dust collecting and removing device 2 of the a knit fabric manufacturing apparatus 1 permits the suction operation to act on one or both of the dust collecting portions 3 and 4 of the circular knitting machine 5 and the yarn supply portion 6 so that the dust particles are adsorbed and the air is cleaned in the circular knitting machine 5 and in the yarn supply portion 6 in the same manner as set forth above, the dust particles are accumulated on the filters 31, 67 and 73 of the dust collecting portions 3 and 4. Whereupon, the suction force by the filter 31 acts on the collecting nozzles 37 and 75 so that the dust particles accumulated on the filters 31, 67 and 73 are collected by the collecting box 38.

At the time of collecting the dust accumulated on the filters 31, 67 and 73, the filters 31, 67 and 73 are intermittently moved so as to recover the adsorbing capacity while moving the filters 31, 67 and 73 and to stop the operation of the filters 31, 67 and 73 when cleaning air which includes the dust particles.

With the arrangement of the dust collecting and removing device in a circular knitting machine and knitting manufacturing apparatus as mentioned above, namely, since the outer casing 17 having the lower opening is provided over the circular knitting machine 5 and the dust collecting body 27 having the bottom plate 28 and filter 31 is provided in the outer casing 17 while the suction device 26 is provided in the outer casing 17 and the suction flow passage 34 is provided between the outer peripheral wall of the outer casing 17 and the filter 31, the suction operation acts on the knitting portion 7 and the yarn supply devices 15, 15*a* of the circular knitting machine 5 so that the air including the flies is sucked by the filter 31, thereby collecting the dust. As a result, the yarn breakage and the deterioration of the quality of the knit fabric can be prevented.

Since the lower portion of the adjustable plate 46 provided at the upper portion of the knitting portion 7 of the circular knitting machine 5 has the cylindrical portion 48, it is possible to permit the suction operation to act smoothly on the knitting portion 7 of the circular knitting machine 5, thereby effectively collecting the dust particles which are generated in the knitting portion 7 of the circular knitting machine 5. Further, since the ring plate 49 is fixed on the cylindrical portion 48 outside the cylindrical portion 48, it is possible to permit the suction operation to act on the yarn supply devices 15, 15*a* effectively at the suction flow passage 53 formed between the ring plate 49 and the frame body 20 of the outer casing 17. Further, since the blowing nozzle 36 is provided inside the filter 31 and the collecting nozzle 37 is provided outside the filter 31, and the collecting nozzle 37 is connected to the collecting box 38, the dust particles accumulated on the filter 31 can be collected due to the synergistic effect of the blowing nozzle 36 and collecting nozzle 37, thereby recovering the adsorbing capacity of the filter 31. Still furthermore, since the filter 31 is rotatable, the blowing nozzle 36 and collecting nozzle 37 can be fixed to the outer casing 17, etc. so that the collecting box 38 and collecting nozzle 37 can be directly connected to each other, thereby simplifying the structure.

Since the radius of $\phi 2$ of the outer periphery of the filter 31 is larger than the opening radius of $\phi 1$ of the lower opening 19 of the outer casing 17, when the suction operation against the filter 31 is stopped due to unexpected trouble, even if the dust particles accumulated on the outer peripheral surface of the filter 31 drop, they do not drop inside the circular knitting machine 5 but drop on the frame body 20 of the outer casing 17, thereby preventing the dust particles from being stuck to the knit fabric when the apparatus stops.

Since the creels 56, 56*a* are disposed inside the housing 54 in the yarn supply portion 6, and the detachable surfaces of the yarn packages are covered by the flexible curtains 58, 58*a*, the flies generated in the yarn supply portion 6 can be prevented from being scattered outside from the yarn supply portion 6. Further, since the creels 56, 56*a* can be approached by merely rolling up the flexible curtains 58, 58*a* the yarn packages 55, 55*a* can be replaced easily with new ones in a short time. Further, since the air blower 60 is provided over the housing 54 and the dust collector 62 is provided under the housing 54, it is possible to blow off and remove the dust particles in the housing 54, thereby preventing the dust from being scattered toward the circular knitting machine 5. Still further, since such air current is generated in the housing 54, it is possible to stably supply the yarn which travels from the yarn packages 55, 55*a* to the knitting portion 7 of the circular knitting machine 5 without swinging. Further, since the filter cleaning device 74 is provided for cleaning the filter 67 of the dust collector 62 and the filter cleaning device 74 is connected to the collecting box 38, it is possible to collect the dust stuck to the filter 67 of the dust collector 62, thereby recovering the adsorbing capacity of the filter 67.

Still furthermore, since the collecting box 38 also generates the suction force like the filters 31 and 67 of the dust collecting body 27 and dust collector 62 in the circular knitting machine 5 and yarn supply portion 6, it is possible to reduce the collecting box 38 and also reduce the space to be involved in installing the collecting box 38. Still further, since the dust collecting portions 3 and 4 are provided in the circular knitting machine 5 and yarn supply portion 6 and the dust collecting and removing device 2 are provided respectively at the portions where the dust particles are generated in the knitting room where the knit fabric manufacturing apparatus I is installed, whereby the knitting room can be cleaned due to the synergistic effect. Other various effects can be obtained by the dust collecting and removing device in a circular knitting machine and knitting manufacturing apparatus.

What is claimed is:

1. A dust collecting and removing device of a circular knitting machine for collecting dust from a knitting portion thereof, comprising:

a first outer casing having wall means defining a first interior chamber and a suction opening in communication with said hitting portion to collect dust therefrom;

a first dust collecting body having means for securing said first dust collecting body within said hollow interior of said outer casing, said first dust collecting body having a plate member and a rotatable cylindrical first filter which has an annular shape, said first filter having an interior surface which defines a hollow filter interior having a first end and a second end that is covered by said plate member, and an exterior surface which is spaced from said wall means so as to define a first suction passage therebetween;

means for rotating said first filter;

a first suction device in communication with said filter interior downstream of said first end which effects a flow of air from said first suction passage, through said first filter and into said filter interior so that filtered dust collects on said first filter;

a blowing nozzle fixed on said knitting machine within said filter interior, said blowing nozzle directed toward said interior filter surface for blowing said filtered dust outwardly from said filter;

a collecting nozzle fixed on said knitting machine in communication with said first suction passage, said collecting nozzle being directed toward said exterior filter surface and aligned with said blowing nozzle for receiving said filtered dust blown thereby; and a collecting container in communication with said collecting nozzle.

2. The collecting and removing device according to claim 1, wherein said first outer casing includes a bottom surface which defines said suction opening, said bottom surface and said plate member of said first dust collecting body being disposed in an opposing spaced relation to define a second suction passage extending between said first suction passage and said suction opening.

3. The collecting and removing device according to claim 2, wherein said exterior surface of said first filter has a radius which is greater than a radius of said suction opening.

4. The collecting and removing device according to claim 7, which includes an adjusting plate having means for locating said adjusting plate proximate said knitting portion, said adjusting plate having a hollow cylindrical portion which defines an axially opening suction passage having a first end in communication with said knitting portion and a second end in communication with said first suction passage through said suction opening, and a ring plate which is fixed to said cylindrical portion proximate said second end and extends outwardly from said cylindrical portion, said bottom surface and said ring plate being disposed in an opposed spaced apart relation to define a radially opening suction passage therebetween, said radially opening suction passage having a first side in communication with at least one yarn supply device of said hitting machine to receive dust therefrom and a second side in communication with said first suction passage through said suction opening.

5. The collecting and removing device according to claim 4, wherein said exterior surface of said first filter has a radius which is greater than a radius of said suction opening.

6. The collecting and removing device according to claim 4, wherein said means for locating said adjusting plate permits adjustment of said adjusting plate relative to said knitting portion and said suction opening.

7. The collecting and removing device according to claim 1, wherein said knitting machine includes a yarn feeding portion for feeding yarn to said knitting portion, said yarn feeding portion including a hollow housing, a plurality of creels disposed within said housing, and a plurality of yarn packages secured to said creels, said housing being open adjacent said creels and having flexible curtains attached thereto so as to enclose said openings and cover said yarn packages, said dust collecting and removing device further including a blower disposed at one end of said housing which is directed into said housing so as to blow dust from said creels by an air flow, a second dust collector body positioned at another end of said housing for receiving said dust and having a hollow second casing and a second filter through which said air flow must pass upon entering said second casing, a filter cleaning device being disposed adjacent said second filter of said second dust collector body which suctions dust therefrom, said filter cleaning device being in communication with said collecting container.

8. The collecting and removing device according to claim 7, wherein said first outer casing includes a bottom surface which has an annular shape and defines said suction opening, said bottom surface and said plate member of said first dust collecting body being in an opposing spaced relation to define a second suction passage extending between said first suction passage and said suction opening, said exterior surface of said filter having a radius which is greater than a radius of said suction opening.

9. The collecting and removing device according to claim 7, wherein said second filter extends about a periphery of said second casing and is movable about said periphery, said filter cleaning device being stationary and directed toward said second filter and having a second suction device which applies a suction to said second filter during movement thereof.

10. The collecting and removing device according to claim 9 wherein said second duet collector body includes third suction device within said hollow second casing which applies a suction to said second filter.

* * * * *

UNITED STATES PATENT AND TRADEMARK OFFICE

CERTIFICATE OF CORRECTION

PATENT NO. : 5 557 949

DATED : September 24, 1996

INVENTOR(S) : Masakazu MORI et al

It is certified that error appears in the above-indentified patent and that said Letters Patent is hereby corrected as shown below:

On the title page, item [75] and in Column 1; change "Masakazu Mori, Aichi-ken; Toyotoshi Yoshioka, Toyota, both of Japan" to ---Masakazu Mori and Toyotoshi Yoshioka, both of Aichi-ken, Japan---.

Column 9, line 31; change "said hitting" to ---said knitting---.

Column 10, lines 4-5; change "Claim 7" to ---Claim 2---;

line 17; change "hitting" to ---knitting---;

and line 63; change "duet" to ---dust---.

Signed and Sealed this

Eleventh Day of February, 1997

Bruce Lehman

*Attest:*

BRUCE LEHMAN

*Attesting Officer*

*Commissioner of Patents and Trademarks*